US006237687B1

(12) United States Patent
Barbee, Jr. et al.

(10) Patent No.: US 6,237,687 B1
(45) Date of Patent: May 29, 2001

(54) METHOD AND APPARATUS FOR PLACING A GRAVEL PACK IN AN OIL AND GAS WELL

(75) Inventors: John Phillip Barbee, Jr., Gretna; Roger Trudeau, Marrero, both of LA (US); John Tims Red, Carriere, MS (US)

(73) Assignee: Eclipse Packer Company, Harvey, LA (US)

( * ) Notice: Subject to any disclaimer, the term of this patent is extended or adjusted under 35 U.S.C. 154(b) by 0 days.

(21) Appl. No.: 09/329,104

(22) Filed: Jun. 9, 1999

(51) Int. Cl.[7] ..... E21B 43/04

(52) U.S. Cl. ..... 166/278; 166/51; 166/134; 166/212; 166/187; 175/61

(58) Field of Search ..... 166/51, 134, 187, 166/212, 278, 303; 175/61

(56) References Cited

U.S. PATENT DOCUMENTS 4,726,419 * 2/1988 Zunkel ..... 166/51
5,069,280 * 12/1991 McKee et al. ..... 166/278
5,377,749 1/1995 Barbee ..... 166/120
5,620,050 4/1997 Barbee ..... 166/278
5,975,205 * 11/1999 Carisella ..... 166/278

* cited by examiner

*Primary Examiner*—Roger Schoeppel
(74) *Attorney, Agent, or Firm*—Garvey, Smith, Nehrbass & Doody, LLC

(57) ABSTRACT

A hydraulic oil and gas well downhole packer apparatus for use in a well casing below a wellhead and in combination with a coil tubing unit provides a tool body having a longitudinally extending tool bore and an upper end portion that connects to the lower free end of the coiled tubing unit during use. The tool body includes an inner elongated hollow mandrel with a hydraulic piston movably disposed upon the external surface of the mandrel. The piston is movable between an initial "running" position and a final "setting" position. An external sleeve is engaged by the piston when it moves between the running and setting positions, the external sleeve engaging slips that expand to anchor the tool body to the well casing. An annular packer member is expandable responsive to sliding movement of the external sleeve and is positioned below the slips for forming a seal between the tool body and the casing at a position near the lower end portion of the tool body.

29 Claims, 6 Drawing Sheets

METHOD AND APPARATUS FOR PLACING A GRAVEL PACK IN AN OIL AND GAS WELL

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to downhole oil well tools, and more particularly relates to an improved method and apparatus for setting a gravel pack in a downhole oil and gas well environment.

2. General Background of the Invention

There are a number of applications in the oil and gas well drilling industry where it is desirable to install a packer in an oil and gas well whose "annulus" or internal diameter is restricted by existing equipment. One downhole oil and gas well delivery system is known in the industry as a "coil tubing" unit. By using a coil tubing unit, it is possible to run a tool in a well that is very restricted in diameter because of existing equipment. However, there are many oil and gas well drilling operations that are not feasible heretofore with the small diameter coil tubing units.

Gravel packing is a mechanical means of preventing sand flow from unconsolidated formations in a producing well. If the sand flow is not controlled, serious and costly problems, such as, loss of production due to sand bridging, failure of casing or liners from removal of surrounding formation, compaction, erosion and disposal of produced materials. U.S. Patents that relate to gravel packs include U.S. Pat. Nos. 5,620,050 and 5,377,749 issued to Phil Barbee, applicant herein, each hereby incorporated herein by reference.

The purpose of a screen in gravel packs is to hold the gravel in place. The slot width or wire spacing should be smaller than the smallest gravel used. The outside diameter of the screen should provide maximum radial clearance of the casing wall while maintaining an adequate internal diameter for anticipated production rates. Screen sections should provide five feet of minimum overlap above and below the perforated interval to compensate for depth measurement inaccuracies. If the gravel is to be circulated into place, the screen may extend further above the perforated interval to develop a higher column of compacted gravel above the completion interval.

Two commonly used techniques for the placement of gravel are the "squeeze technique" and the "one trip circulating technique".

The squeeze technique is primarily used for gravel packing short intervals. Gravel is squeezed through the perforations to pack outside the casing and in the screen annulus without circulation. If the squeeze technique is used in longer intervals, variations of the formation permeability may cause all the slurry to go into the highest permeable section of the interval. Although longer intervals have been successfully squeezed, it is recommended that this technique be limited to shorter intervals.

A squeeze packer with a crossover tool is used to place the gravel pack. The screen and the blank pipe are run in the hole and positioned across the productive interval. The packer is set and the crossover opened. The slurry is then "bullheaded" down a workstring, through crossover tool, into the screen-casing annulus, and through the perforations in the casing. Pumping is continued until a pre-determined pressure increase or "sandout" pressure occurs, indicating that no more gravel can be "squeezed" outside of the casing or into the annulus. Once a "sandout" is achieved, pumping is discontinued and treatment pressures are vented before physically pulling the crossover tool to the "upper" circulating position. After the upper circulating position has been accomplished, pumping is resumed to circulate any excess gravel remaining in the workstring to surface.

The one trip circulating technique is typically better suited for longer intervals than the squeeze technique, but can be used for any length interval. A washpipe is positioned inside and extending through the screen to accommodate the circulation of fluids and gravel to the bottom of the screen. A gravel slurry is circulated down the tubing, through a crossover tool, down the screen-casing annulus, through the screen, up the washpipe, through the crossover tool and returns up the workstring-casing annulus. Gravel contained in the slurry is separated out of the circulating fluid as it passes through the screen.

As the screen is covered with gravel, the circulation pressure increases, forcing gravel into the perforations. Pumping is continued until a pre-determined pressure increase or "sandout" occurs indicating that no more gravel can be circulated outside of the casing or into the annulus. Once a "sandout" is achieved, pumping is discontinued and treatment pressures are vented before pulling the crossover tool to the "upper" circulating position. After the upper circulating position is accomplished, pumping is resumed to circulate out any excess gravel remaining in the workstring.

Slurry rates may vary as low as 0.25 bbl/min to in excess of 16.0 bbl/min depending on workstring or tubular diameters and the well configuration. Higher rates result in higher treating pressures which generally promote tighter packing of gravel. At higher placement rates, friction pressure is incurred due to pumping the slurry down relatively long lengths of tubing. These friction pressures tend to "mask" the actual down-hole differential pressure from the screen exterior to the screen interior during a "sandout".

BRIEF SUMMARY OF THE INVENTION

The present invention features a sliding sleeve, type pressure activated bypass valve. Once in the "lower" circulating position, the hydraulic pressure, incurred as a result of achieving a predetermined "sandout" pressure, shifts the sleeve-type valve to an open position. Once the valve is open, a flow path or by-pass for the excess slurry is exposed allowing the gravel pack media to be circulated back to surface.

A pre-determined "sandout" pressure can be accurately controlled by the adjustable shear value for activation (opening) of the crossover tool by-pass valve. The crossover tool by-pass valve allows for a non-stop pumping operation. The continuous pumping eliminates the opportunity for gravel to settle out of static fluid that may inhibit crossover tool movement or removal from the packer bore. The excess gravel is totally evacuated from the packer/crossover tool vicinity prior to repositioning or removing the crossover tool from the packer bore.

The present invention provides an improved oil and gas well downhole packer apparatus for use in well casing below the wellhead, and can be used in combination with a coil tubing unit having an elongated coil tubing portion, a reel portion for coiling the tubing thereupon, and a free end portion of the tubing that can be transmitted into the well casing below the wellhead area.

In the preferred embodiment, the apparatus includes a tool body having a central, longitudinally extending hollow tool body bore, an upper end portion and a lower end portion. Threads at the top end portion of the tool body assembly are provided for forming a connection between the tool body assembly and the lowermost free end portion of the coil tubing. In this fashion, as coil tubing is unwound from the reel, the coil tubing pays out and the free end portion of the coil tubing lowers into the well with the tool body attached.

The coil tubing provides a bore that can be used to transmit pressurized fluid to the tool body during use. The hydraulic pressure transmitted to the tool body via the coil tubing unit is used to activate the tool body such as, for example, in setting of the packer. Further, the bore of the coil tubing unit is used to transmit coarse sand or gravel from the wellhead area to the tool body for use in gravel packing operation.

The tool body includes an elongated tubular inner mandrel having a polished inner bore, a hydraulic piston that is movably disposed upon the mandrel between a first running position and a second setting position. An external sleeve portion of the tool body surrounds the mandrel and the piston and can be in several parts connected end to end. The external sleeve defines a sliding portion that connects for movement with the hydraulic piston when the hydraulic piston moves from the initial running position to the second setting position.

Slips on the lower end portion of the tool body are annularly spaced around the mandrel for engaging the well casing to anchor the tool body to the casing at a selected position. Means are provided for forming a connection between the piston and the slips for activating the slips to grip the well casing.

An expandable annular packer is provided for forming a seal with the well casing and between the well casing and the inner mandrel. The packer is expandable responsive to movement of a sliding portion of a tool so that the packer expands when the piston moves downwardly from the initial running position to the final setting position.

In the preferred embodiment, the packer is a resilient member such as, for example, of a rubber or polymeric construction. In the preferred embodiment, the coil tubing and tool body are sized to enter a very restricted well bore such as, for example, an internal diameter of about two inches or less.

During use, the tool body assembly comprises in part an uppermost running tool portion that includes means for connecting the running tool portion to the coil tubing.

The method of the present invention provides a method for gravel packing an oil and gas well having a wellhead at the earth's surface and a well annulus defined by the well casing. The method includes the initial step of lowering a packer having a valving member into the well casing on the coil tubing string, and attached to the straight, free end portion of the coil tubing.

The packer is placed in the well annulus and at a selected elevational position of the well casing to be packed with coarse sand or gravel.

The packer is activated to form an annular seal against the casing by elevating pressure in the coil tubing.

The valve is opened at a selected position below the seal element. After opening the valve, gravel or coarse sand (as selected) can be transmitted via the coil tubing unit bore and into the tool body bore with a carrying fluid. The coarse sand or gravel and carrying fluid enters the well annulus below the seal element.

In the method of the present invention, the valve member includes a sliding sleeve valve that opens responsive to an increase in pressure within the tool body bore.

In the preferred method, the tool body supports a screening member at the lower end portion of the tool body so that the carrying fluid that enters the well annulus can be returned to the surface via the screen and the bore of the tool body so that the screen prevents return flow of coarse sand and gravel that is used for the gravel pack.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 2A:
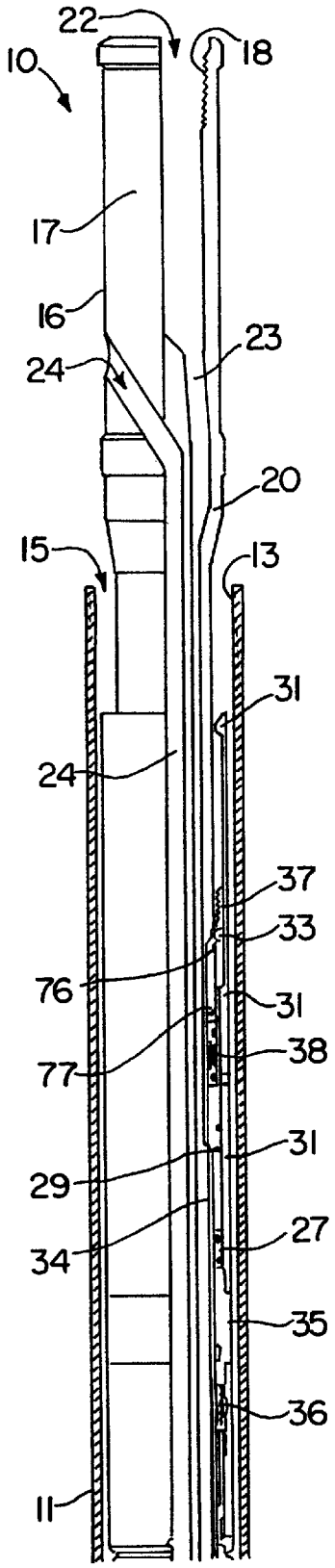
FIGS. 2A, 2B, and 2C are upper, middle and lower respective portions of a sectional view of the preferred embodiment of the apparatus of the present invention showing the apparatus set and with the coil tubing unit in tension but 2A, 2B and 2C match together end to end.
Figure 1A:
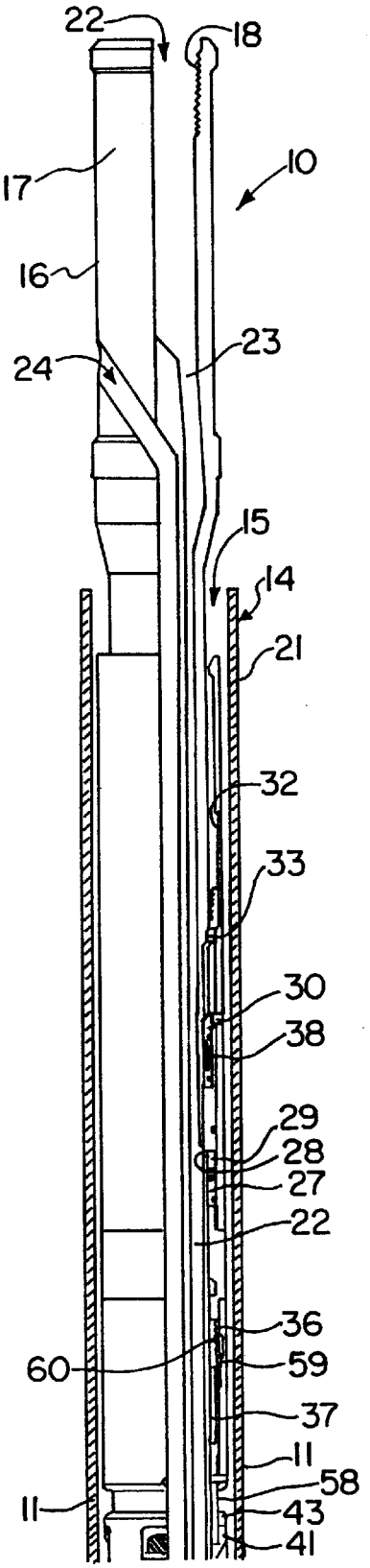
FIGS. 1A, 1B and 1C are upper, middle and lower respective portions of a sectional view of the preferred embodiment of the apparatus of the present invention shown in a preliminary "running in" position wherein 1A, 1B and 1C match together end to end.
Figure 2B:
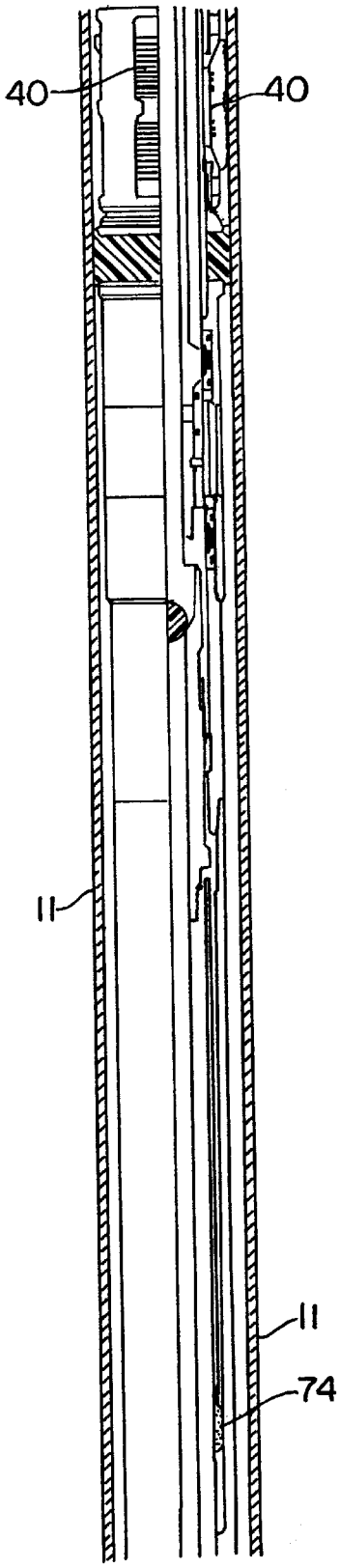
Figure 1B:
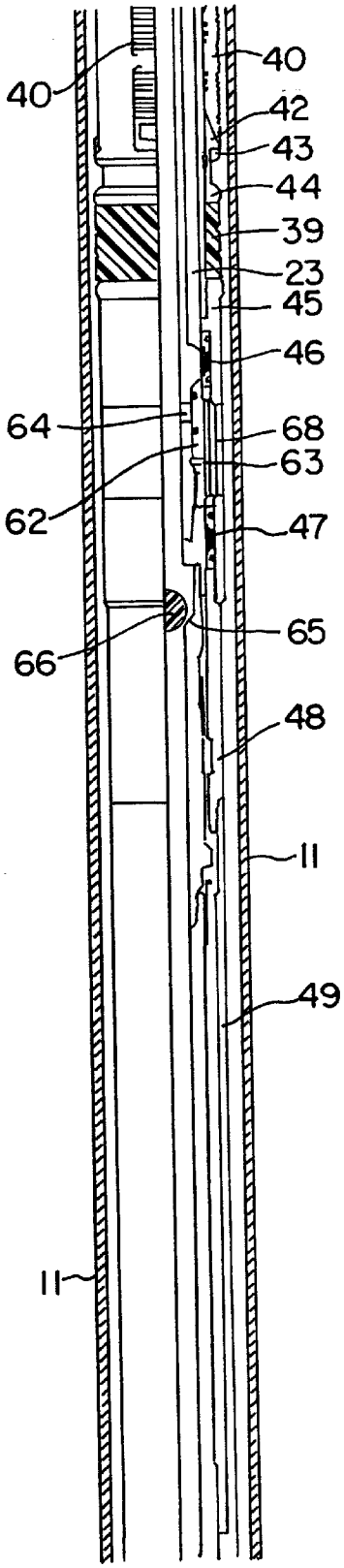
Figure 2C:
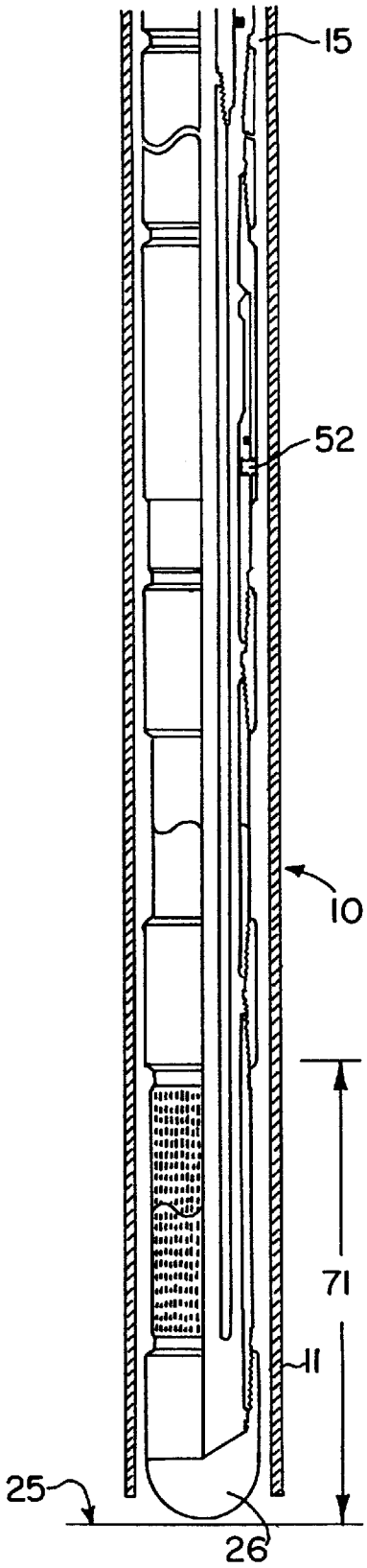
Figure 1C:
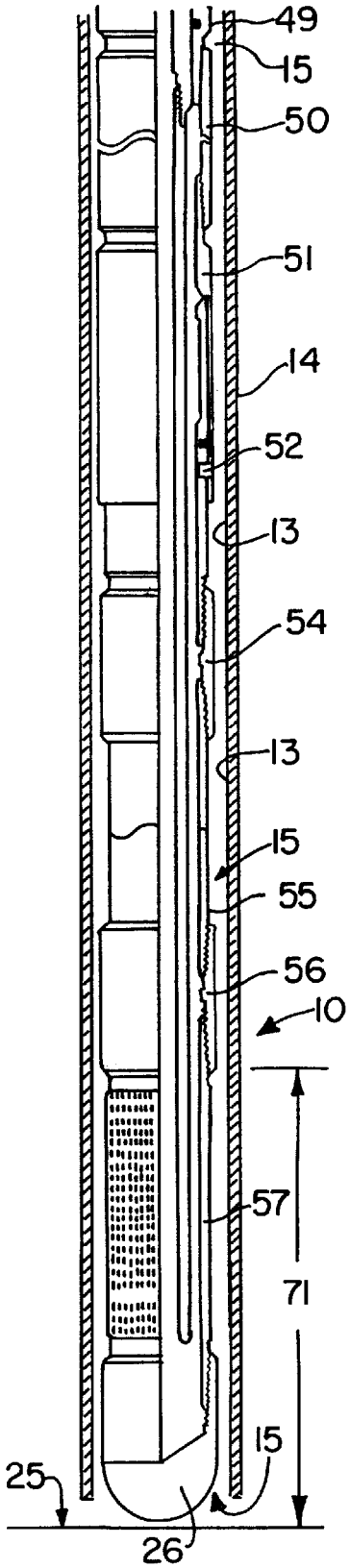

FIGS. 1 and 2 show the preferred embodiment of the apparatus of the present invention designated generally by the numeral 10. Downhole well tool apparatus 10 is shown in FIGS. 1 and 2 in a downhole position inside casing 11. The casing 11 is generally cylindrically shaped, comprising a casing wall 12 having an inside surface 13 and an outside surface 14.

FIG. 1 shows a position of the tool apparatus 10 as it is being lowered into the well, known in the industry as a "running in" position. In FIG. 1, the tool apparatus has not been deployed, and is free to move up and down in the well casing 11, being lowered on preferably a coil tubing unit. Coil tubing units are well known in the art for lowering elongated downhole well tools into an oil and gas well. A coil tubing unit provides an elongated length of continuous tubing with an internal flow bore that can flow pressurized fluid to the tool apparatus 10 for activating its slips 40 and for expanding its annular elastomeric seal member 39 into engagement with the inside surface 13 of the casing 11.

The slips 40 and annular elastomeric seal member 39 are activated as the first step of the method of the present invention as shown in FIG. 2. When the well tool apparatus 10 has been lowered to a desired elevational position, the slips 40 and elastomeric seal member 39 are activated so that they both grip the inside surface 13 of casing 11. With the method and apparatus of the present invention, the tool apparatus 10 is lowered to a desired elevational position that is next to a perforated zone 71. The perforated zone 71, as is known in the art, is a portion of the casing 11 that has been perforated so that oil and gas can flow from the surrounding formation through the perforations in the casing 11 and into the well annulus 15.

Figure 6A:
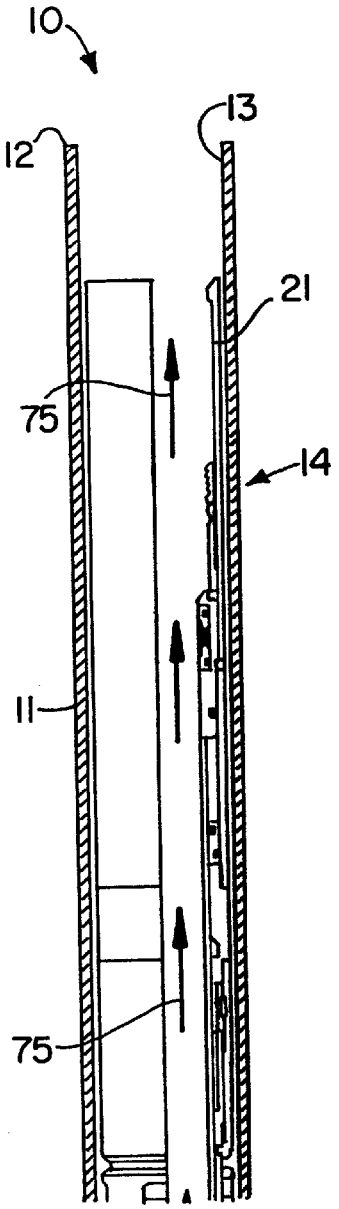
FIGS. 6A, 6B and 6C are upper, middle and lower respective portions of a sectional view of the preferred embodiment of the apparatus of the present invention showing the well producing and sleeve latched across the gravel ports wherein 6A, 6B, 6C match together end to end.
Figure 5A:
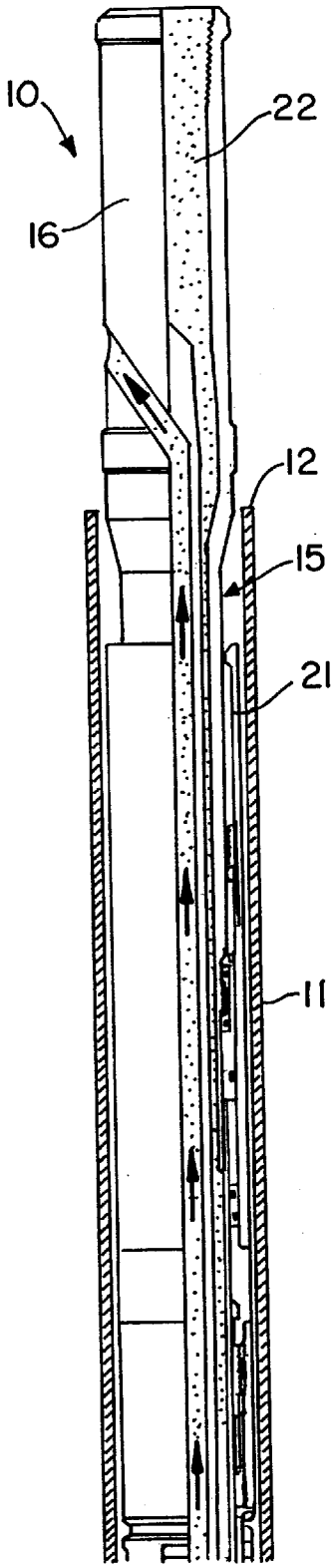
FIGS. 5A, 5B and 5C are upper, middle and lower respective portions of a sectional view of the preferred embodiment of the apparatus of the present invention showing the differential valve opened, formation isolated, and circulating out through the bypass channel wherein 5A, 5B and 5C match together end to end.
Figure 6B:
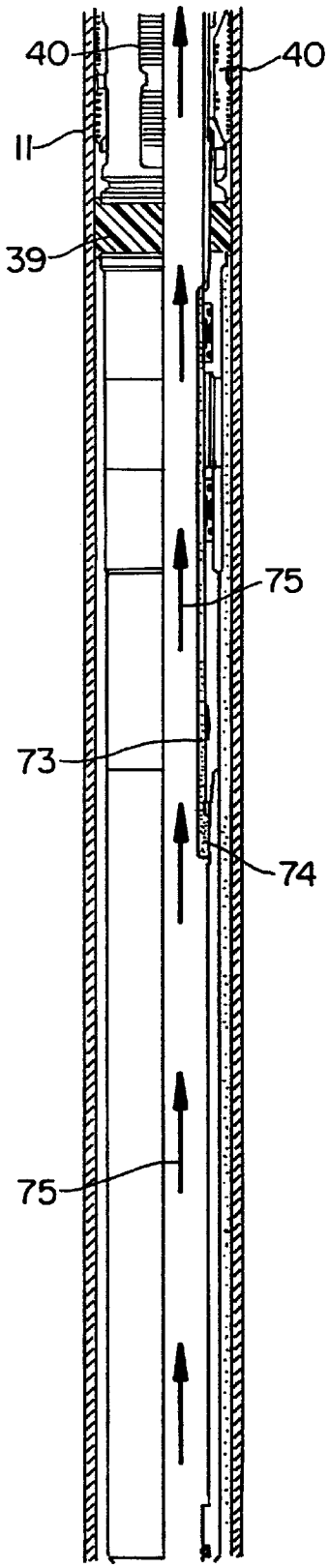
Figure 5B:
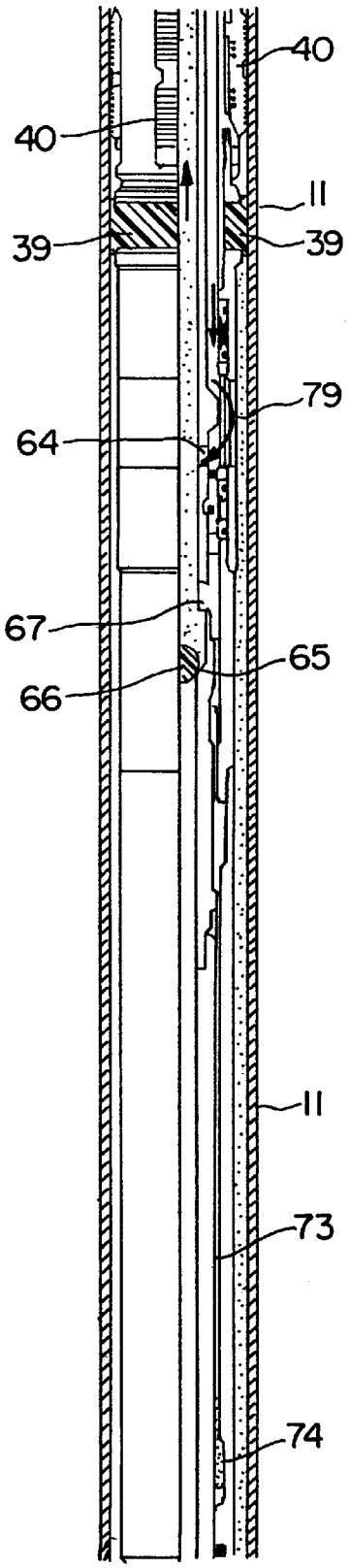
Figure 6C:
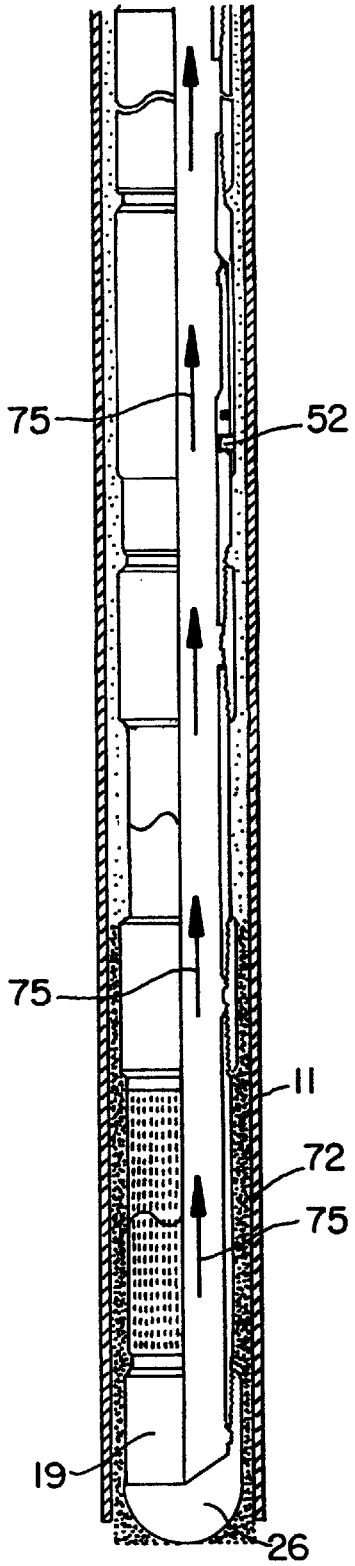
Figure 5C:
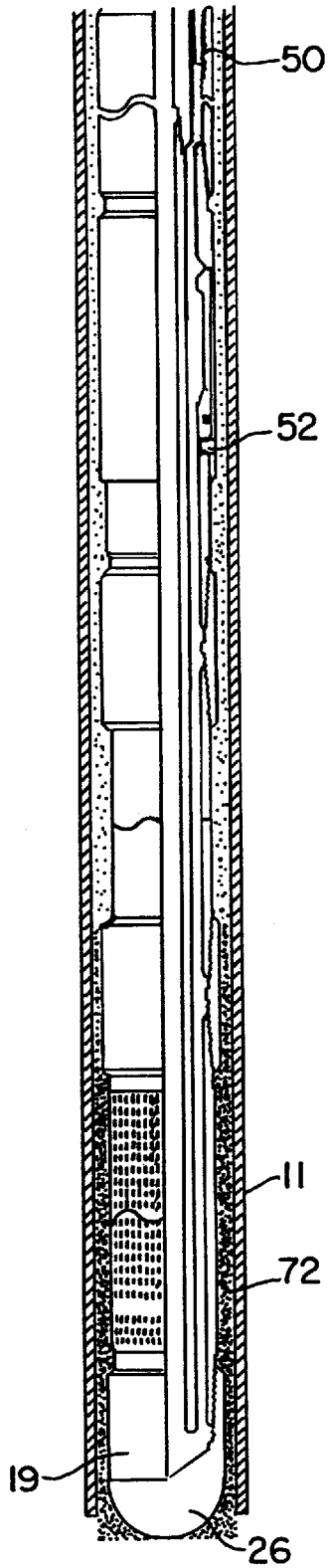

The well 15, as is known in the art, is that portion of the well inside the casing 11 surrounded by inside surface 13 of casing wall 12. With the method of the present invention, a gravel pack is placed to form an interface in between the surrounding formation and a flow bore of the tool apparatus 10 through which oil and gas will flow to the surface, as indicated by the arrows 75 in FIG. 6.

In FIG. 2, the slips 40 and elastomeric seal member 39 have been activated by pumping pressurized fluid through the coil tubing unit to the bore 22 of the tool body 10. The pressurized fluid enters bore 22 of tool body 10 and then flows through circulating channel 23 of crossover tool 20 to port 28.

The tool body 10 includes a crossover tool 20 and a packer body 21. The packer body 21 includes a fixed section 34 and moving portions as will be described more fully hereinafter. In FIGS. 1 and 2, port 28 receives pressurized fluid that is pumped via the coil tubing unit to bore 22 and circulation channel 23. Pressurized fluid flows through port 28 into annular space 29 so that it acts upon piston 27.

The piston 27 is forced downwardly as shown in a comparison of FIGS. 1 and 2. When the piston 27 moves downwardly with respect to fixed section 34 it pushes upon connector sub 35, ratchet mechanism 36, release sleeve 58, cones 41, 42, gauge sub 44, and sub 45. This downward movement of the aforementioned parts causes the cones 41, 42 to push slips 40 outwardly so that they engage the inside surface 13 of casing 11 as shown in FIGS. 2–6. At the same time, the gauge sub 44 and sub 45 move together squeezing the annular elastomeric seal member 39 outwardly so that it engages the inside surface 13 of casing 11 as shown in FIGS. 2–6. These parts are held in this position by the ratchet mechanism 36. The ratchet mechanism 36 moves downwardly, engaging toothed section 37 as shown in FIGS. 1 and 2. The ratchet mechanism includes segment retainer 59 and body lock ring 60.

The pressurized fluid that is used to activate the tool apparatus 10 is attached to tool body 16 at its upper end portion 16 at a suitable connection such as, for example, a connector at the lower end portion of the coil tubing unit that engages internal threads 18 of tool body 16.

In order to properly register the tool apparatus 10 at a desired position in the well, one technique is to clean the well to a desired depth so as to create a bottom 25 of the well that is engaged by lower end portion 19. Lower end 19 provides a preferably hemispherically shaped tip 26 as shown in FIGS. 1–6. Once the tool apparatus 10 has been set, slips 40 and annular elastomeric seal member 39 grip the inside surface 13 of casing 11. A slurry that includes gravel and/or coarse sand can be pumped downhole through the coil tubing unit to the bore 22 of the tool body 16 and then into circulating channel 23. In FIG. 2, a tension test can be used to assure that the slips 40 are properly gripping the casing 11 wall 12. By pulling on the coil tubing unit, tension is applied to the tool apparatus 10 to test the grip of the slips 40 against the casing 11.

Figure 3A:
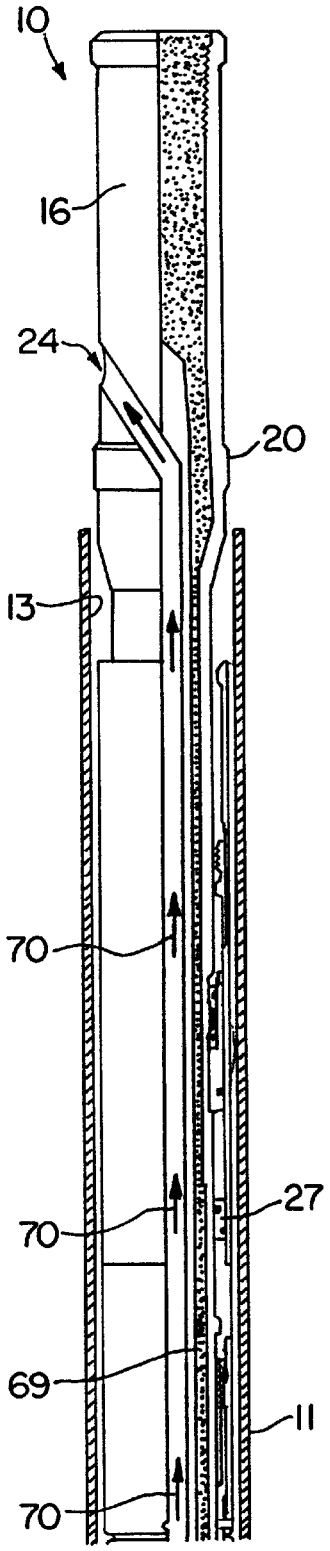
FIGS. 3A, 3B, and 3C are upper, middle and lower respective portions of a sectional view of the preferred embodiment of the apparatus of the present invention showing the tool body set with the coil tubing unit in compression and circulating a slurry through the tool body wherein 3A, 3B, and 3C match together end to end.
Figure 3B:
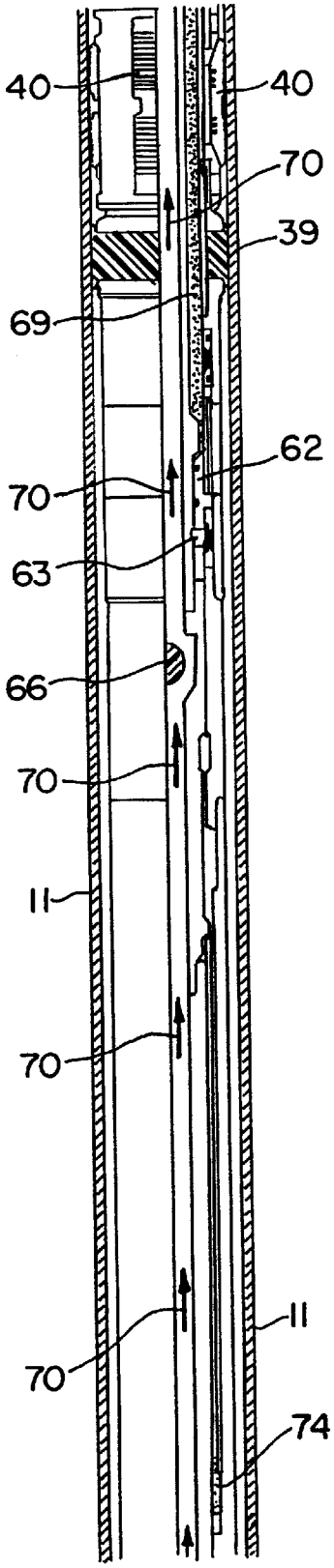
Figure 3C:
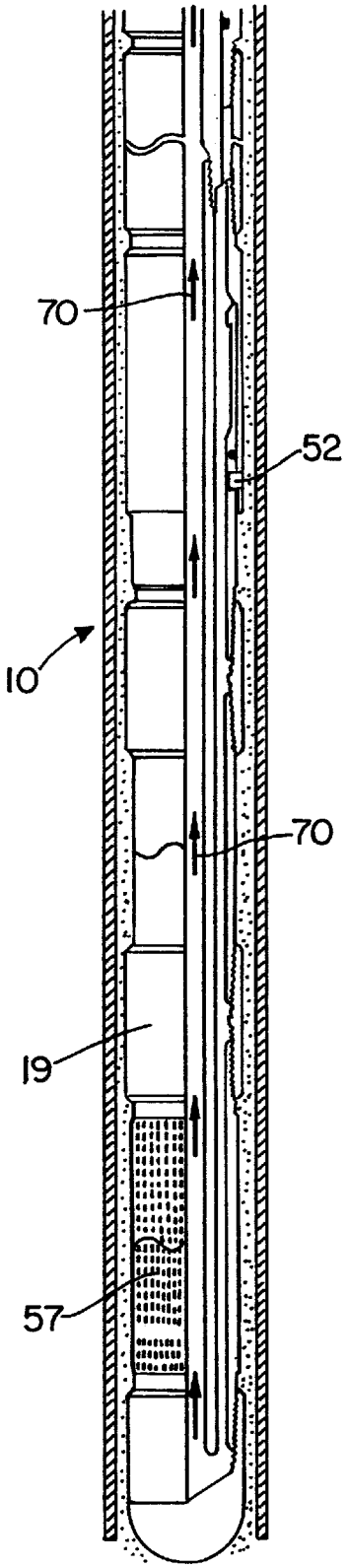

After the pull test of FIG. 2, the tool apparatus is then set by applying compression with the coil tubing unit thus forcing a portion of the tool apparatus 10 downwardly as shown in FIG. 3. In FIG. 3, compression has been applied by the coil tubing unit to the upper end portion 17 of the tool body 16. A shear pin 30 is used to prevent inadvertent preliminary shifting of the tool apparatus 10 between FIGS. 1 and 2. In FIG. 1, the shear pin 30 has not yet been cut. In FIG. 2, the shear pin 30 has been sheared so that the piston 27 can move downwardly.

Downward movement of the cross over tool 20 relative to the fixed section 34 of tool body 16 is limited by engagement of annular surface 76 on cross over tool 20 with annular shoulder 77 on packer body 21. This engagement of annular surfaces 76, 77 can be seen in FIG. 3. A comparison of FIGS. 2 and 3 shows movement of the cross over tool downwardly relative to the packer body 21.

In FIG. 3, downward movement of the cross over tool 20 opens gravel port 68 as shown in FIG. 3. In FIG. 2, an expanded portion 78 of cross over tool 20 engages middle seal 46. When the cross over tool 20 shifts downwardly in FIG. 3, the expanded portion 78 moves away from middle seal 46 so that port 68 is opened. In this position (FIG. 3) a slurry of fluid and gravel and/or coarse sand can be pumped from the coil tubing unit to the tool body bore 22 to the circulating channel 23 and then to the port 68. This gravel slurry is indicated by the number 69 in FIGS. 3 and 4.

Figure 4A:
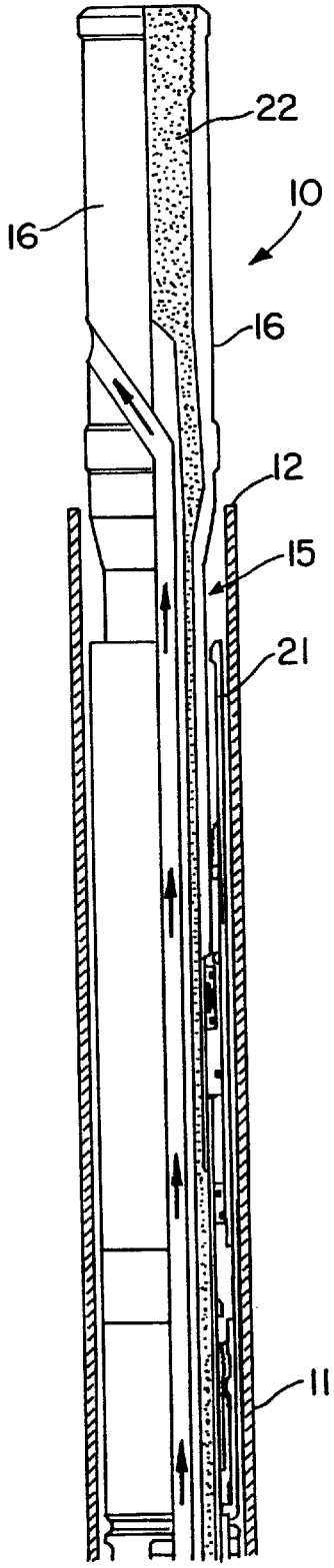
FIGS. 4A, 4B and 4C are upper, middle and lower respective portions of a sectional view of the preferred embodiment of the apparatus of the present invention showing the circulating slurry during the building of sand height on the screen when setting the gravel pack wherein 4A, 4B and 4C match together end to end.
Figure 4B:
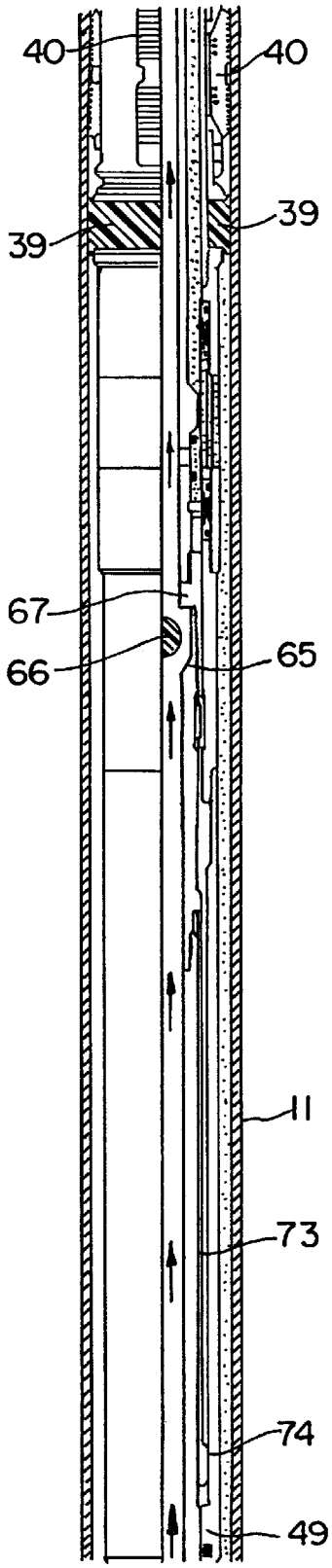
Figure 4C:
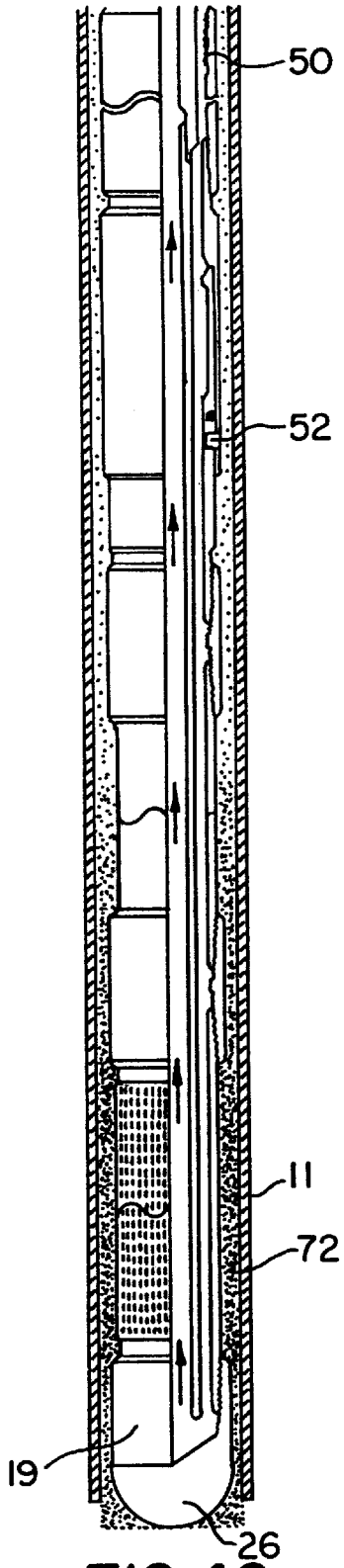

After the slurry 69 passes from circulating channel 23 through port 68 to annulus 15, it flows downwardly in the annulus 15 past a number of portions of the apparatus 10 until it reaches well screen 57. In FIGS. 1–4, a portion of the tool body 16 below gravel port 68 includes sub 45, middle seals 46, lower seal 47, annular section 48, annular section 49, connector 50, sleeve 51, shear pin 52, sleeve 53, connector 54, sleeve 55, connector 56, and well screen 57. In FIG. 4, the slurry 69 flows down until it reaches the bottom 25 of the well and the area in between perforated section 71 and screen 57.

One of the features of the present invention is that the desired pressure across the screen after the gravel pack is in place (sand out pressure) can be set to a very specific pressure value. This is accomplished by first measuring circulating pressure before any sand or gravel is pumped down hole into the bore 22 of the tool body 16. This circulating pressure of fluid only can be, for example, 2,000 p.s.i. If it is desired to have a pressure of, for example, 3,000 p.s.i. across the gravel pack and screen, the present invention will automatically set that pressure value at 3,000 lbs. by opening bypass valve 62 as soon as the downhole fluid pressure reaches 3,000 p.s.i. Thus, with the present invention, the circulating pressure rises as more and more sand and/or gravel is pumped with the gravel slurry 69 to the area in between well screen 57 and perforated zone 71. As more and more sand and/or gravel is pumped to this area as shown in FIGS. 2, 3 and 4, resistance to the fluid being pumped and the slurry being pumped increases. Petroleum engineers can calculate a desired sand out pressure knowing the formation that they are dealing with. For example, if the sand out pressure is set at 3,000 p.s.i., the engineer knows that when 3,000 p.s.i. has been reached by measuring the pump pressure, sufficient gravel and/or sand has been packed in between the perforated zone 71 and the well screen 57.

The present invention provides a valving mechanism that automatically stops the flow of circulating gravel slurry 69 to the area in between the perforated zone 71 and the well screen 57 by opening a bypass port 64. In FIG. 4, the bypass port 64 is closed with bypass valve 62. Shear pin 63 holds the bypass valve 62 in the closed position. As the gravel pack area 72 receives more and more sand and/or gravel, the circulating pressure of the pump at the well head rises. When the selected pressure value (for example 3,000 psi) is reached, that pressure value of 3,000 psi is acting upon the valving member 62. The shear pin 63 is sized and of a selected material such that it shears at exactly the desired downhole well pressure of, for example, 3,000 psi. When the shear pin 63 shears, the valving member 62 moves downwardly to the position shown in FIG. 5. This causes fluid to take the path of least resistance as shown by arrows 79 in FIG. 5. As fluid flows through bypass port 64, it enters the return channel 24. This creates pressure that pushes ball valving member 66 down so that it seals upon beveled annular seat 65.

A fluted section 67 of cross over tool 20 enables fluid to flow upwardly in return channel 24 as indicated by arrows 70 during the formation of the gravel pack. The ball valving member 66 may move upwardly and engage fluted section 67 during such return flow as indicated by the arrows 70 in FIG. 3. In such a situation, circulation can take place by simply flowing through the fluted section and around the ball valving member.

One of the advantages of the apparatus 10 of the present invention is that circulating slurry 69 will automatically divert through the bypass port 64 into return channel 24 as soon as the desired circulating pressure value is reached. An additional benefit of the bypass port 64 and valve 62 construction is that any sand and gravel that is flowing in circulating channel 23 when the valving member 62 is activated to move to the position of FIG. 5 will either fall harmlessly into the well annulus 15 below gravel port 68 or will travel back to the well head area via return channel 24 and the well annulus 15 above tool body 16.

After the gravel pack has been completed, closure sleeve 73 can be used to close gravel port 68. The tool body 16 is lifted upwardly and the tool body 16 and cross over tool 20 separated from packer body 21. In such a situation, closure sleeve 73 shifts upwardly to engage middle seal 46 and lower seal 47. Now, the well can produce oil and gas as it flows from the surrounding formation through the perforated section 71 of well casing 11, and through well screen 57 into the tool body bore 22 as shown by arrows 75 in FIG. 6.

Shear pin 52 enables the majority of the packer body 21 to be removed from the well bore by applying tension in case the bottom of the tool body is stuck. This shear pin 80 thus provides a safety feature so that the top of the tool body can be pulled out if the well screen 57 is stuck.

The sleeve sections 51, 53, 55, can be blank tubing that are very long in length such as for example, any distance of 10–2,000 ft. Similarly, the well screen 57 can be very long such as for example, 10–2,000 ft.

PARTS LIST

The following is a list of suitable parts and materials for the various elements of the preferred embodiment of the present invention.

PARTS LIST

| NUMBER | PART |
|---|---|
| 10 | downhole well tool |
| 11 | casing |
| 12 | casing wall |
| 13 | inside surface |
| 14 | outside surface |
| 15 | annulus |
| 16 | tool body |
| 17 | upper end portion |
| 18 | internal threads |
| 19 | lower end portion |
| 20 | cross over tool |
| 21 | packer body |
| 22 | bore |
| 23 | circulating channel |
| 24 | return channel |
| 25 | bottom of well |
| 26 | hemispherical tip |
| 27 | piston |
| 28 | port |
| 29 | annular space |
| 30 | shear screw |
| 31 | moving annular set sleeve |
| 32 | relief surface |
| 33 | running segment |
| 34 | fixed section tool body |
| 35 | connector sub |
| 36 | ratchet mechanism |
| 37 | toothed section |
| 38 | seal |
| 39 | annular elastomeric seal member |
| 40 | slip |
| 41 | cone |
| 42 | cone |
| 43 | slip holder |
| 44 | gauge sub |
| 45 | sub |
| 46 | middle seal |
| 47 | lower seal |
| 48 | annular section |
| 49 | annular section |
| 50 | connector |
| 51 | sleeve |
| 52 | shear pin |
| 53 | sleeve |
| 54 | connector |
| 55 | sleeve |
| 56 | connector |
| 57 | well screen |
| 58 | release sleeve |
| 59 | retainer segment |
| 60 | body lock ring |
| 61 | seal |
| 62 | bypass valve |
| 63 | shear pin |
| 64 | bypass port |
| 65 | beveled annular seat |
| 66 | ball valve member |
| 67 | fluted section |
| 68 | gravel port |
| 69 | gravel slurry |
| 70 | arrow |
| 71 | perforated area |
| 72 | gravel pack area |
| 73 | closure sleeve |
| 74 | thickened section |

-continued

| PARTS LIST | |
|---|---|
| NUMBER | PART |
| 75 | arrow |
| 76 | annular shoulder |
| 77 | annular shoulder |
| 78 | expanded portion |
| 79 | arrow |

The foregoing embodiments are presented by way of example only; the scope of the present invention is to be limited only by the following claims.

What is claimed is:

1. A method of gravel packing an oil and gas well with a circulating gravel pack, said well having a wellhead at the earth's surface, a well annulus, and a well casing, comprising the steps of:

a) lowering a tool body having a packer and a valving member into the well casing on a work string having a fluid conveying work string bore;

b) placing the tool body in the well casing and at a selected elevational position of the well casing to be packed with sand;

c) activating the packer to form an annular seal against the casing by elevating pressure in the work string bore;

d) anchoring the tool body to the casing with slips;

e) opening the valving member at a position below the annular seal;

f) transmitting sand in a carrying fluid via the work string bore to the opened valving member so that the sand and carrying fluid enters the well annulus below the seal to form a gravel pack with a selected sand out pressure valve;

g) opening a return channel by activating a valving member with fluid pressure that is about equal to the sand out pressure;

h) circulating the carrying fluid back to the earth's surface via a channel that extends through the tool body from below the packer to a position above the packer;

i) wherein in step "g" the valving member includes a piston that slides relative to the tool body between closed and open positions.

2. The method of claim 1 further comprising the step of screening carrying fluid that enters the well annulus and returning the screened fluid to the wellhead area.

3. A method of gravel packing an oil and gas well having a wellhead at the earth's surface, a well annulus, and a well casing, with a circulating gravel pack comprising the steps of:

a) lowering a tool body having a packer and a valving member into the well casing on a coil tubing string that includes a straight portion disposed in the well casing and a coiled portion on a reel that is positioned at the wellhead;

b) placing the tool body in the well casing and at a selected elevational position of the well casing to be packed with gravel or coarse sand;

c) activating the packer to form an annular seal against the casing by elevating pressure in the coil tubing;

d) opening the valving member at a position below the annular seal;

e) transmitting gravel or coarse sand in a carrying fluid via the coil tubing and packer bore to the opened valving member so that the gravel or coarse sand and carrying fluid enters the well annulus below the seal to form a gravel pack with a selected sand out pressure valve;

f) opening a return port that enables circulating of the carrying fluid back to the earth's surface via a return flow channel that extends through the tool body from below the packer to a position above the packer; and g) wherein in step "f" the return port is opened by activating a second valving member.

4. The method of claim 3 further comprising the step of screening carrying fluid that enters the well annulus and returning the screened fluid to the wellhead area.

5. A method of setting a gravel packer in an oil and gas well having a wellhead at the earth's surface and a well annulus defined by a well casing, comprising the steps of:

a) lowering a tool body that includes a packer, a well screen and a valving member into the well casing on a coil tubing string that includes a straight portion disposed in the well casing and a coiled portion on a reel that is positioned at the wellhead;

b) placing the tool body in the well annulus and at a selected elevational position of the well casing;

c) activating the packer to form an annular seal against the casing by elevating pressure in the coil tubing;

d) transmitting a circulating fluid carrying sand from the coil tubing string to the tool body and into the well annulus below the packer;

e) allowing sand to travel to the screen and form a gravel pack so that fluid circulation pressure increases because of resistance generated by the sand packed at the screen; and f) opening a return channel when the increasing pressure reaches a pre-selected value.

6. The method of claim 5 further comprising the step of anchoring the packer to the casing with slips.

7. The method of claim 5 wherein step "c" further comprises expanding the packer and wherein the packer includes an annular resilient member that expands upon activation of the packer.

8. The method of claim 5 wherein the packer has a transverse crossover opening below the annular seal in step "c" and further comprising the step of transmitting gravel or coarse sand in a carrying fluid to the well annulus via the coil tubing, packer and crossover opening.

9. The method of claim 8 further comprising the step of transmitting gravel or coarse sand in a carrying fluid via the coil tubing to the crossover opening so that the gravel, coarse sand and carrying fluid enters the well annulus below the seal element.

10. The method of claim 9 further comprising the step of screening carrying fluid that enters the well annulus and returning the screened fluid to the wellhead area.

11. A method of gravel packing an oil and gas well having a wellhead at the earth's surface, a well annulus, and a well casing, with a circulating gravel pack comprising the steps of:

a) lowering a tool body having a packer, a screen, and a valving member into the well casing on a work string;

b) placing the tool body in the well casing and at a selected elevational position of the well casing to be packed with gravel or coarse sand;

c) activating the packer to form an annular seal against the casing by elevating pressure in the coil tubing;

d) opening the valving member at a position below the annular seal;

e) transmitting a circulating fluid carrying sand from the work string to the tool body and into the well annulus below the packer;

f) allowing sand to travel to the screen and form a gravel pack so that fluid circulation pressure increases because of resistance generated by the sand packed at the screen; and g) opening a return channel when the increasing pressure reaches a pre-selected valve.

12. The method of claim 11 further comprising the step of anchoring the packer to the casing with slips before transmitting gravel or coarse sand to the packer.

13. The method of claim 11 further comprising the step of expanding the packer and wherein the packer includes an annular resilient member that expands upon activation of the packer.

14. The method of claim 11 further comprising the step of screening the carrying fluid at a position near the bottom of the tool body and returning the screened carrying fluid to the wellhead area.

15. The method of claim 11 further comprising the step of anchoring the packer to the casing with slips.

16. A method of gravel packing an oil and gas well having a well casing and an annulus, comprising the steps of:

a) placing an elongated tool body in the well casing with a work string, next to a section of the casing to be gravel packed, the tool body having upper and lower end portions, an annular seal member, a flow bore, a transverse port below the annular seal that communicates between the flow bore and the annulus, a well screen at the tool body lower end portion, a return channel, and a bypass port that communicates between the return channel and the flow bore;

b) activating the annular seal member to form a seal between the tool body and the casing;

c) opening the transverse port;

d) transmitting a circulating fluid carrying gravel or coarse sand from the work string to the well annulus below the annular seal member via the tool body flow bore and transverse port, the circulating fluid having a circulating fluid pressure;

e) using the transmitted carrying fluid to pack the well screen with gravel or coarse sand to form a gravel pack that generates resistance to flow and increased circulating fluid pressure;

f) using the increasing circulating fluid pressure to open the bypass port when a selected sand out pressure is reached;

g) transmitting circulating fluid to the wellhead via the bypass port, return channel and well annulus above the annular seal member.

17. The method of claim 16 wherein the tool body includes a fluid pressure operated valving member, and in step "e" the valving member opens responsive to an elevation in circulating fluid pressure to a selected pressure value.

18. The method of claim 16 wherein the tool body includes a fluid pressure operated valving member, and in step "e" the valving member is held in a closed position with a shear pin and the valving member opens responsive to an elevation in circulating fluid pressure to a selected pressure value and the pin is sheared.

19. The method of claim 16 wherein the selected pressure value is a pre-selected sand out value.

20. The method of claim 16 wherein in step "f" the circulating fluid includes some gravel or coarse sand.

21. The method of claim 16 further comprising the step of anchoring the tool body to the well annulus at a position spaced from the annular seal member.

22. The method of claim 16 wherein the tool body has slips and further comprising the step of anchoring the tool body to the well annulus with the slips at a position spaced from the annular seal member.

23. The method of claim 16 further comprising the step of closing the transverse port.

24. The method of claim 23 wherein the tool body has a sliding sleeve that shifts to close the transverse port.

25. The method of claim 16 wherein the tool body has a well screen at its lower end portion, and in step "d" the screen is packed with coarse sand or gravel.

26. A method of gravel packing an oil and gas well having a well casing and an annulus, comprising the steps of:

a) placing an elongated tool body in the well casing with a work string next to a section of the casing to be gravel packed, the tool body having upper and lower end portions, a screen, a flow bore, a transverse port that communicates between the flow bore and the annulus, a bypass port and a return channel;

b) opening the transverse port;

c) transmitting a circulating fluid carrying sand from the work string to the well annulus via the tool body flow bore and transverse port;

d) using the transmitted carrying fluid to pack the screen with sand to form a gravel pack that generates resistance to flow and increased circulating fluid pressure;

e) using the increasing pressure to open the bypass port when a selected sand out pressure is reached; and f) transmitting circulating fluid that includes some sand to the wellhead via the bypass port and return channel.

27. A hydraulic oil and gas well down hole apparatus for installing a gravel pack in an oil and gas well with a well casing and annulus comprising:

a) a tool body having an upper end portion with means for connecting the tool body to a coil tubing unit with a bore for transmitting pressurized fluid to the tool body;

b) a hydraulic piston movably disposed in the tool body between running and setting positions;

c) a sliding external sleeve portion connected at its lower end for movement with the hydraulic piston;

d) a plurality of slips on the tool body for engaging the casing to anchor the tool body to the casing at a selected elevational position;

e) a cone assembly forming a connection between the piston and the slips for activating the slips to grip the well casing;

f) an annular packer that is expandable by the cone assembly for forming a seal between the tool body and the casing at a position below the piston;

g) a locking portion on the tool body for locking the slips;

h) a plurality of fluid circulation channels in the tool body that include a flow bore that connects to the coil tubing unit bore, a transverse port that extends between the flow bore and the well annulus, a return channel that enables circulating return fluid to flow from the tool body to the annulus above the seal member, and a bypass port that enables fluid to communicate between the flow bore and the return channel; and i) a valve that valves the bypass port, said valve moving between open flow and closed flow positions, wherein increasing circulating fluid pressure within the fluid circulation channels caused by resistance from the gravel pack operates to open the valve.

28. The apparatus of claim 27 wherein the packer is an annular resilient packer member.

29. An oil and gas well down hole packer apparatus comprising:

a) a tool body that includes a piston and having a central, longitudinally extending tool body bore, and an upper end portion with means of connecting the tool body to a coil tubing unit;

b) a bore for transmitting pressurized fluid to the tool body bore from a coil tubing unit;

c) slips on the tool body for engaging the casing to anchor the tool body to the casing at a selected position;

d) a cone assembly forming a connection between the piston and the slips for activating the slips to grip the well casing;

e) an annular packer that is expandable by the cone assembly to form a seal between the tool body and the casing at a selected position;

f) a plurality of fluid circulation channels in the tool body that include a flow bore that connects to the coil tubing unit bore, a transverse port that extends between the flow bore and the well annulus, a return channel that enables circulating return fluid to flow from the tool body to the annulus above the seal member, and a bypass port that enables fluid to communicate between the flow bore and the return channel; and g) a valve that valves the bypass port, said valve moving between open flow and closed flow positions, wherein increasing circulating fluid pressure within the fluid circulation channels caused by resistance from the gravel pack operates to open the valve.

* * * * *